US006015375A

United States Patent [19]

Moss

[11] Patent Number: 6,015,375

[45] Date of Patent: Jan. 18, 2000

[54] CENTRIFUGE WITH A CENTRIFUGAL DRUM SUBDIVIDED INTO A PEELING CHAMBER AND A HYDROHERMETIC CHAMBER

[75] Inventor: Reinhard Moss, Ennigerloh, Germany

[73] Assignee: Westfalia Separator AG, Oelde, Germany

[21] Appl. No.: 09/101,608

[22] PCT Filed: Jul. 15, 1997

[86] PCT No.: PCT/DE97/01490

§ 371 Date: Jul. 17, 1998

§ 102(e) Date: Jul. 17, 1998

[87] PCT Pub. No.: WO98/05431

PCT Pub. Date: Feb. 12, 1998

[30] Foreign Application Priority Data

Aug. 2, 1996 [DE] Germany ..... 196 31 226

[51] Int. Cl.[7] ..... B04B 11/00

[52] U.S. Cl. ..... 494/27; 494/38; 494/56

[58] Field of Search ..... 494/23, 27, 28, 494/29, 30, 38, 56, 68–73

[56] References Cited

U.S. PATENT DOCUMENTS 3,317,126 5/1967 Little et al. ..... 494/27
4,695,270 9/1987 Zettier ..... 494/70
4,718,886 1/1988 Mackel ..... 494/27
5,167,609 12/1992 Graw et al. ..... 494/27

FOREIGN PATENT DOCUMENTS 40 14 552 C1 7/1991 Germany .

*Primary Examiner*—Charles E. Cooley
*Attorney, Agent, or Firm*—Henry M. Feiereisen

[57] ABSTRACT

A centrifuge has a centrifugal drum with a peeling chamber and a hydrohermetic chamber (locking chamber) (7). The centrifuge is so designed that solids deposited at the periphery (outer bottom 19) of the locking chamber (7) are carried away with the overflow stream of the sealing liquid or/and with the flow of the cleaning medium during CIP method of the space located between the centrifugal drum (2) and the centrifuge housing. A second locking chamber lid (1) is located between a locking disk (9) of the locking chamber (7) and a lid (17) for forming with the first lid a flow channel (20) for carrying away solids deposited on the outer bottom of the locking chamber via an overflow weir (16). The centrifuge is used in the field of separation technology, in particular when high hygienic requirements are applied, e.g. in the field of the foodstuff industry.

5 Claims, 1 Drawing Sheet

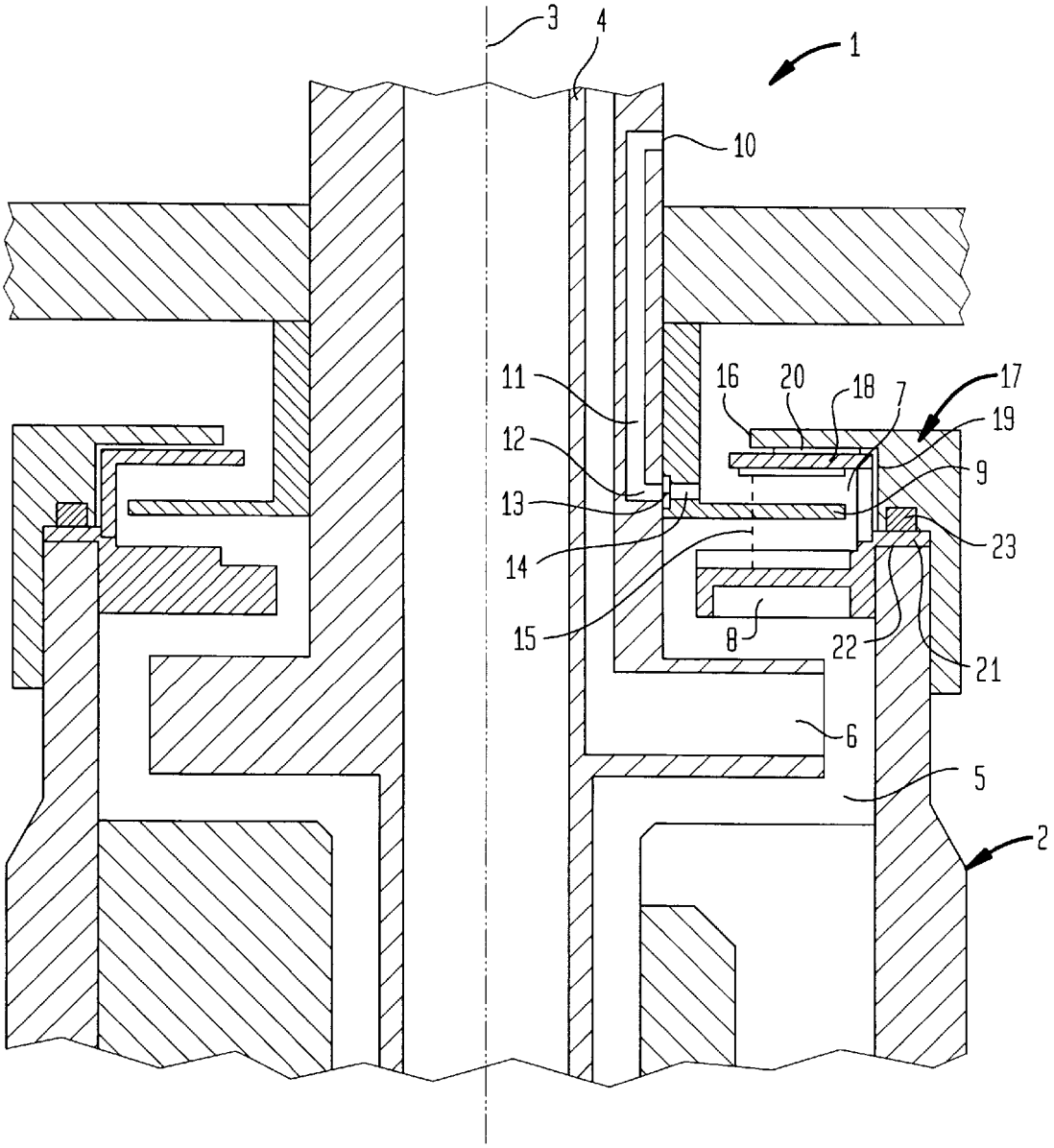
3
4
1
10
11
16
20
18
7
17
19
12
9
13
23
14
15
8
22
21
6
5
2

CENTRIFUGE WITH A CENTRIFUGAL DRUM SUBDIVIDED INTO A PEELING CHAMBER AND A HYDROHERMETIC CHAMBER

BACKGROUND OF THE INVENTION

The invention relates to a centrifuge with vertical pivot axis, including a centrifugal drum formed with a peeling chamber which is connected via at least one drain channel to the partition space of the centrifugal drum and having a peeling device disposed in the peeling chamber for effecting a continuous drain of a liquid phase clarified or separated in the centrifugal drum, as well as a locking disk located above the peeling chamber and securely fixed to the peeling device, with the locking disk projecting in a locking chamber circulating conjointly with the centrifugal drum, wherein the peeling device is provided with a channel for supply of a sealing liquid into the locking chamber, and the locking chamber is bounded upwardly and outwardly by a lid having a free edge facing the pivot axis and forming an overflow weir.

Water or another foreign liquid may be used as sealing liquid that is introduced from outside into the locking chamber.

The peeling chamber situated above the peeling chamber and called also hydrohermetic chamber prevents penetration of atmospheric air into the peeling chamber and thus into the liquid phase peeled off from this chamber.

There is known a centrifuge of the above-stated type (DE 40 14 552 C1), in which deposits of solids may form at the periphery of the locking chamber during operation and cannot be flushed out even during CIP method. These deposits, in so far as being of organic nature, may start to decay, so that the product passing through the centrifuge can be contaminated.

SUMMARY OF THE INVENTION

The invention is based on the object to so design a centrifuge of the afore-stated type that deposits of solids at the periphery (at the outer bottom) of the locking chamber are discharged with the overflow stream of the sealing liquid or/and with the drain flow of the cleaning medium during a CIP method in the space between centrifugal drum and centrifuge housing.

This object is attained in accordance with the invention by arranging between the locking disk and the first lid a second locking chamber lid which is inwardly offset with respect to the outer bottom of the locking chamber and forms with the first lid a flow channel for carrying away solids deposited on the outer bottom of the locking chamber via the overflow weir.

The flow channel, which is bounded by both lids of the locking chamber, encounters during operation of the centrifuge upon addition of sealing water a directed flow which carries away solids deposited on the outer bottom, on the periphery of the locking chamber via the overflow weir.

The CIP method (cleaning in place) includes a liquid cleaning medium which is guided through the centrifuge at full rotating speed. Through throttling of the drain pressure of the peeling device, the liquid level in the peeling chamber can be shifted thereby radially inwards to such an extent that liquid flows from the peeling chamber via the inner boundary of the overflow into the locking chamber, thereby resulting in an intense thorough flushing of the locking chamber by a stream through the flow channel defined by both lids. All solids deposited on the periphery of the locking chamber are thereby flushed out, leading to a hygienically clean hydrohermetic chamber.

Further features of the invention are subject matter of the sub-claims.

BRIEF DESCRIPTION OF THE DRAWING

An exemplified embodiment of the centrifuge according to the invention is illustrated in the drawing and described hereinafter. The drawing shows a partial vertical section of the centrifuge.

DETAILED DESCRIPTION OF PREFERRED EMBODIMENTS

The centrifuge 1 has a centrifugal drum 2 supported for rotation about a vertical axis 3 and includes an inlet pipe 4 through which the product to be separated by the centrifuge into several phases is fed into the centrifugal drum 2.

A liquid phase of the product is directed into a peeling chamber 5 and guided from there under pressure via a peeling device 6 for discharge from the centrifuge.

Located above the peeling chamber 5 is a locking chamber 7 which circulates conjointly with the centrifugal drum 2, with an overflow 8 arranged between the peeling chamber 5 and the locking chamber 7 and forming a partition wall between both these chambers.

A locking disk 9 projects into the locking chamber 7, which moves conjointly with the centrifugal drum 2, and is connected to the peeling device and thus fixed in place. Sealing liquid, e.g. sealing water, is introduced into the locking chamber 7 through a bore 10, a channel 11 and a bore 12, which branches from this channel 11, and via an annular space 13 and an outlet 14, forming a sealing liquid level 15 which is determined by an overflow weir 16 formed by the free inner edge of a lid 17 that bounds the locking chamber upwardly and outwardly. The free edge, which forms the overflow weir 16, faces the pivot axis 3.

Arranged between the locking disk 9 and the first lid 17 is a second locking chamber lid 18. This second locking chamber lid 18 is inwardly offset with respect to the outer bottom 19 of the locking chamber 7 and forms with the first lid 17 a flow channel 20 for discharge of solids deposited on the outer bottom of the locking chamber under the impact of centrifugal forces during operation of the centrifuge. The discharge is effected under the influence of excess sealing liquid which flows through the flow channel 20 and thereby carries away the solids via the overflow weir 16, or under the influence of an intense stream of a cleaning medium which is guided during CIP method through the locking chamber 7 and thereby through the flow channel 20. During CIP method, a throttling of the drain pressure of the peeling device so shifts the liquid level in the peeling chamber radially inwards that liquid flows from the peeling chamber via the inner boundary of the overflow into the locking chamber.

As can be seen from the graphic illustration, the second locking chamber lid 18 projects beyond the first lid 17 at the side facing the pivot axis 3.

The second locking chamber lid 18 is connected to the overflow 8 between the peeling chamber 5 and the locking chamber 7. This structural unit includes an outwardly extending ring flange 21 which is secured between the first lid 17 and an upper end face 22 of the centrifugal drum 2. A sealing ring 23 is anchored in a groove of the first lid 17 and is supported by the ring flange 21.

As shown in the drawing, the second locking chamber lid 18 is arranged adjacent the inner side of the first lid so that the flow channel 20 is configured in the shape of a gap between both these lids.

What is claimed is:

1. A centrifuge, comprising:

a centrifugal drum rotating about a vertical rotational axis and having a peeling chamber;

a peeling device disposed in the peeling chamber for continuously draining a liquid phase clarified or separated in the centrifugal drum;

a locking disk located above the peeling chamber and securely fixed to the peeling device, with the locking disk projecting in a locking chamber circulating conjointly with the centrifugal drum and forming an outer bottom, wherein the peeling device is provided with a channel for supply of a sealing liquid into the locking chamber;

a first lid bounding the locking chamber upwardly and outwardly and having a free edge facing the rotational axis and forming an overflow weir; and a second locking chamber lid arranged between the locking disk and the first lid, said second locking chamber lid being inwardly offset with respect to the outer bottom of the locking chamber and forming with the first lid a flow channel for carrying away solids deposited on the outer bottom of the locking chamber via the overflow weir.

2. The centrifuge according to claim 1, wherein the first lid has an inner side, said second locking chamber lid being arranged adjacent the inner side of the first lid, said flow channel being configured in the shape of a gap.

3. The centrifuge according to claim 1, wherein the second locking chamber lid projects beyond the first lid at a side facing the rotational axis of the centrifugal drum.

4. The centrifuge according to claim 1, and further comprising an overflow device defining a partition wall to form an overflow between the peeling chamber and the locking chamber, said second locking chamber lid being connected to the partition wall, thereby establishing a structural unit which further includes an outwardly extending ring flange which is secured between the first lid and an upper end face of the centrifugal drum.

5. The centrifuge according to claim 4, and further comprising a sealing ring anchored in a groove of the first lid and supported by the ring flange.

* * * * *

UNITED STATES PATENT AND TRADEMARK OFFICE

CERTIFICATE OF CORRECTION

PATENT NO. : 6,015,375
DATED : January 18, 2000
INVENTOR(S) : Reinhard Moss

It is certified that error appears in the above-identified patent and that said Letters Patent is hereby corrected as shown below:

On the title page, Item [54] and Column 1, lines 1 - 4, change "CENTRIFUGE WITH A CENTRIFUGAL DRUM SUBDIVIDED INTO A PEELING CHAMBER AND A HYDROHERMETIC CHAMBER" to --CENTRIFUGE HAVING A CENTRIFUGAL DRUM FORMED WITH A PEELING CHAMBER AND A HYDROHERMETIC CHAMBER--.

Item [57] Abstract: line 8, change "(1)" to --(18)--.

Signed and Sealed this

Sixth Day of March, 2001

*Attest:*

Nicholas P. Godici

NICHOLAS P. GODICI

*Attesting Officer*

*Acting Director of the United States Patent and Trademark Office*